US011737575B2

(12) United States Patent
Cranney et al.

(10) Patent No.: US 11,737,575 B2
(45) Date of Patent: Aug. 29, 2023

(54) COLLAPSIBLE FOLDING BOX SPRING ASSEMBLY

(71) Applicant: CVB INC., Logan, UT (US)

(72) Inventors: Bretton D. Cranney, Hyrum, UT (US); Xie Zhiyong, Xiamen (CN)

( * ) Notice: Subject to any disclaimer, the term of this patent is extended or adjusted under 35 U.S.C. 154(b) by 94 days.

(21) Appl. No.: 17/344,238

(22) Filed: Jun. 10, 2021

(65) Prior Publication Data

US 2022/0395106 A1 Dec. 15, 2022

(51) Int. Cl.
*A47C 23/00* (2006.01)
*A47C 19/12* (2006.01)

(52) U.S. Cl.
CPC ..... *A47C 23/005* (2013.01); *A47C 19/122* (2013.01)

(58) Field of Classification Search
CPC ..... A47C 23/005; A47C 19/12; A47C 31/105; A47C 19/124; A47C 19/126; A47C 19/04; F16B 12/56; F16B 12/54; F16B 12/60
See application file for complete search history.

(56) References Cited

U.S. PATENT DOCUMENTS 3,245,363 A * 4/1966 Kanitz ..... A47B 3/087 182/15
8,312,576 B1 * 11/2012 Oh ..... A47C 23/005 5/177
9,314,386 B1 * 4/2016 Boyd ..... A47C 19/122
2004/0040090 A1 * 3/2004 Wootten ..... A47G 9/0246 5/497
2009/0293193 A1 * 12/2009 Neatherry ..... A47C 23/005 5/1
2016/0143447 A1 * 5/2016 Hull ..... A47C 23/005 5/202
2016/0262547 A1 * 9/2016 Jin ..... A47C 19/021
2016/0316921 A1 * 11/2016 Choi ..... A47C 19/025
2016/0316922 A1 * 11/2016 Choi ..... A47C 19/122
2019/0045938 A1 * 2/2019 Skaggs ..... A47C 19/122

* cited by examiner

*Primary Examiner* — David R Hare
*Assistant Examiner* — Alison N Labarge

(57) ABSTRACT

A collapsible folding box spring assembly comprising a first subassembly that includes top and bottom frame portions; a second subassembly that includes a top and bottom frame portions; first and second T-brackets positioned between the first and second subassemblies in a hinged configuration, wherein the top frame portion of the first subassembly and the top frame portion of the second subassembly are both attached to the T-brackets at a first axis, wherein the bottom frame portion of the subassembly is attached to the T-brackets at a second axis; and wherein the bottom frame portion of the second subassembly is attached to the T-brackets at a third axis; and a plurality of rotating Z-links located between the top and bottom frame portions of the first and second subassemblies for expanding the frame portions when in an open configuration, and collapsing the frame portions when in a closed configuration.

14 Claims, 16 Drawing Sheets

COLLAPSIBLE FOLDING BOX SPRING ASSEMBLY

BACKGROUND

The disclosed inventive subject matter relates in general to bedding products and mattress supports and more specifically to a collapsible, folding box spring that is easily transportable.

Commercially available conventional beds typically include a mattress supported by a box-spring assembly that includes a wooden or metal frame enclosing a series of springs for supporting the weight of the mattress and a person or persons lying on the mattress. A box-spring assembly typically includes a rigid wood and metal construction that makes the box spring assembly heavy and difficult to transport due to its size, weight, and inflexibility. As a result, conventional box spring assemblies do not meet shipping standards for companies such as Amazon and Walmart, both of which engage in significant e-commerce. Therefore, there is an ongoing need for box spring assemblies to be foldable and collapsible for ease of storage and shipping. Box spring assemblies having a comparatively small footprint would reduce transportation costs because more units could be shipped in a single shipping container.

SUMMARY

The following provides a summary of certain example implementations of the disclosed inventive subject matter. This summary is not an extensive overview and is not intended to identify key or critical aspects or elements of the disclosed inventive subject matter or to delineate its scope. However, it is to be understood that the use of indefinite articles in the language used to describe and claim the disclosed inventive subject matter is not intended in any way to limit the described inventive subject matter. Rather the use of "a" or "an" should be interpreted to mean "at least one" or "one or more".

One implementation provides a first example collapsible folding box spring assembly, comprising a first box spring subassembly, wherein the first box spring subassembly includes a top frame portion and a bottom frame portion; a second box spring subassembly, wherein the second box spring subassembly includes a top frame portion and a bottom frame portion; first and second T-brackets positioned between the first and second box spring subassemblies in a hinged configuration, wherein the top frame portion of the first box spring subassembly and the top frame portion of the second box spring subassembly are both attached to the T-brackets at a first axis, wherein the bottom frame portion of the first box spring subassembly is attached to the T-brackets at a second axis; and wherein the bottom frame portion of the second box spring subassembly is attached to the T-brackets at a third axis; and a plurality of rotating Z-links located between the top and bottom frame portions of the first and second box spring subassemblies, wherein each Z-link expands the top frame portions away from bottom frame portions of the first and second box spring subassemblies when in an open configuration, and wherein each Z-link collapses the top frame portions toward the bottom frame portions of the first and second box spring subassemblies when in a closed configuration.

The collapsible folding box spring assembly may further comprise a plurality of stabilizing straps extending between the top and bottom frame portions of the first and second box spring subassemblies. The collapsible folding box spring assembly may further comprise a cover adapted to be placed over the top of the folding box spring assembly. The cover may include four corners and wherein an elastic band is positioned diagonally in each corner for securing the cover to the box spring subassemblies. The collapsible folding box spring assembly may further comprise a plurality of connecting bolts for connecting the folding box spring assembly to a second folding box spring assembly. Each top frame portion may further include lengthwise and widthwise crossbar supports located between an outer frame. Each bottom frame portion may further include lengthwise and widthwise crossbar supports located between an outer frame. Each T-bracket may further include ridges formed thereon for engaging both top and both bottom frame portions. Each Z-link may further include stabilizing ridges formed thereon for engaging both top and both bottom frame portions.

Another example implementation provides a second example collapsible folding box spring assembly, comprising a first box spring subassembly, wherein the first box spring subassembly includes a top frame portion and a bottom frame portion; a second box spring subassembly, wherein the second box spring subassembly includes a top frame portion and a bottom frame portion; first and second T-brackets positioned between the first and second box spring subassemblies in a hinged configuration, wherein the top frame portion of the first box spring subassembly and the top frame portion of the second box spring subassembly are both attached to the T-brackets at a first axis, wherein the bottom frame portion of the first box spring subassembly is attached to the T-brackets at a second axis; and wherein the bottom frame portion of the second box spring subassembly is attached to the T-brackets at a third axis; and a plurality of rotating Z-links located between the top and bottom frame portions of the first and second box spring subassemblies, wherein each Z-link expands the top frame portions away from bottom frame portions of the first and second box spring subassemblies when in an open configuration, and wherein each Z-link collapses the top frame portions toward the bottom frame portions of the first and second box spring subassemblies when in a closed configuration; and a plurality of stabilizing straps extending between the top and bottom frame portions of the first and second box spring subassemblies; and a cover adapted to be placed over the top of the folding box spring assembly.

The cover may include four corners and wherein an elastic band is positioned diagonally in each corner for securing the cover to the box spring subassemblies. The collapsible folding box spring assembly may further comprise a plurality of connecting bolts for connecting the folding box spring assembly to a second folding box spring assembly. Each top frame portion may further include lengthwise and widthwise crossbar supports located between an outer frame. Each bottom frame portion may further include lengthwise and widthwise crossbar supports located between an outer frame. Each T-bracket may further include ridges formed thereon for engaging both top and both bottom frame portions. Each Z-link may further include stabilizing ridges formed thereon for engaging both top and both bottom frame portions.

Still another implementation provides a third collapsible folding box spring assembly, comprising a first box spring subassembly, wherein the first box spring subassembly includes a top frame portion and a bottom frame portion; a second box spring subassembly, wherein the second box spring subassembly includes a top frame portion and a bottom frame portion; first and second T-brackets positioned between the first and second box spring subassemblies in a hinged configuration, wherein the top frame portion of the first box spring subassembly and the top frame portion of the second box spring subassembly are both attached to the T-brackets at a first axis, wherein the bottom frame portion of the first box spring subassembly is attached to the T-brackets at a second axis; wherein the bottom frame portion of the second box spring subassembly is attached to the T-brackets at a third axis, and wherein each T-bracket further includes ridges formed thereon for engaging both top and both bottom frame portions; and a plurality of rotating Z-links located between the top and bottom frame portions of the first and second box spring subassemblies, wherein each Z-link expands the top frame portions away from bottom frame portions of the first and second box spring subassemblies when in an open configuration, wherein each Z-link collapses the top frame portions toward the bottom frame portions of the first and second box spring subassemblies when in a closed configuration, and wherein each Z-link further includes ridges formed thereon for engaging both top and both bottom frame portions; and a plurality of stabilizing straps extending between the top and bottom frame portions of the first and second box spring subassemblies; and a cover adapted to be placed over the top of the folding box spring assembly.

The cover may include four corners and wherein an elastic band is positioned diagonally in each corner for securing the cover to the box spring subassemblies. The collapsible folding box spring assembly may further comprise a plurality of connecting bolts for connecting the folding box spring assembly to a second folding box spring assembly. Each top frame portion may further include lengthwise and widthwise crossbar supports located between an outer frame. Each bottom frame portion may further include lengthwise and widthwise crossbar supports located between an outer frame.

It should be appreciated that all combinations of the foregoing concepts and additional concepts discussed in greater detail below (provided such concepts are not mutually inconsistent) are contemplated as being part of the inventive subject matter disclosed herein and may be implemented to achieve the benefits as described herein. Additional features and aspects of the disclosed system, devices, and methods will become apparent to those of ordinary skill in the art upon reading and understanding the following detailed description of the example implementations. As will be appreciated by the skilled artisan, further implementations are possible without departing from the scope and spirit of what is disclosed herein. Accordingly, the drawings and associated descriptions are to be regarded as illustrative and not restrictive in nature.

BRIEF DESCRIPTION OF THE DRAWINGS

The accompanying drawings, which are incorporated into and form a part of the specification, schematically illustrate one or more example implementations of the disclosed inventive subject matter and, together with the general description given above and detailed description given below, serve to explain the principles of the disclosed subject matter, and wherein.

DETAILED DESCRIPTION

Figure 1:
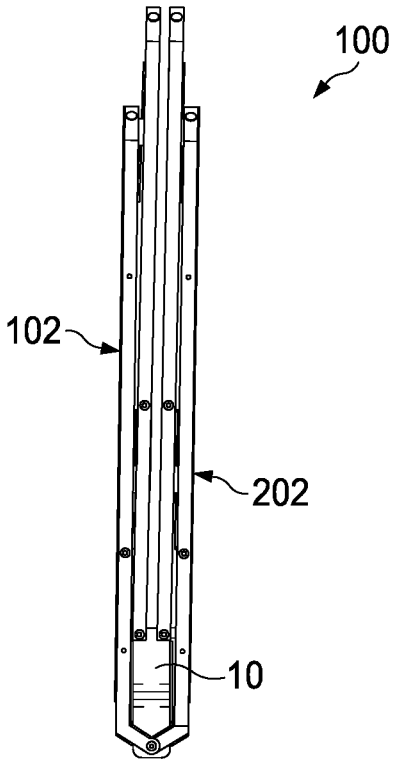
FIG. 1 is a side view of an example implementation of the disclosed folding box spring assembly shown in a completely closed configuration.

Example implementations are now described with reference to the Figures. Reference numerals are used throughout the detailed description to refer to the various elements and structures. Although the following detailed description contains many specifics for the purposes of illustration, a person of ordinary skill in the art will appreciate that many variations and alterations to the following details are within the scope of the disclosed inventive subject matter. Accordingly, the following implementations are set forth without any loss of generality to, and without imposing limitations upon, the claimed subject matter.

The disclosed item provides a collapsible and foldable box spring product or box spring assembly that is of metal construction, typically steel, aluminum, or other suitable metal. Example implementations include a latitude bi-fold design that allows the box spring assembly to fold in half and collapse to reduce its overall size, thereby allowing it to fit into a carton that meets e-commerce shipping requirements.

Figure 2:
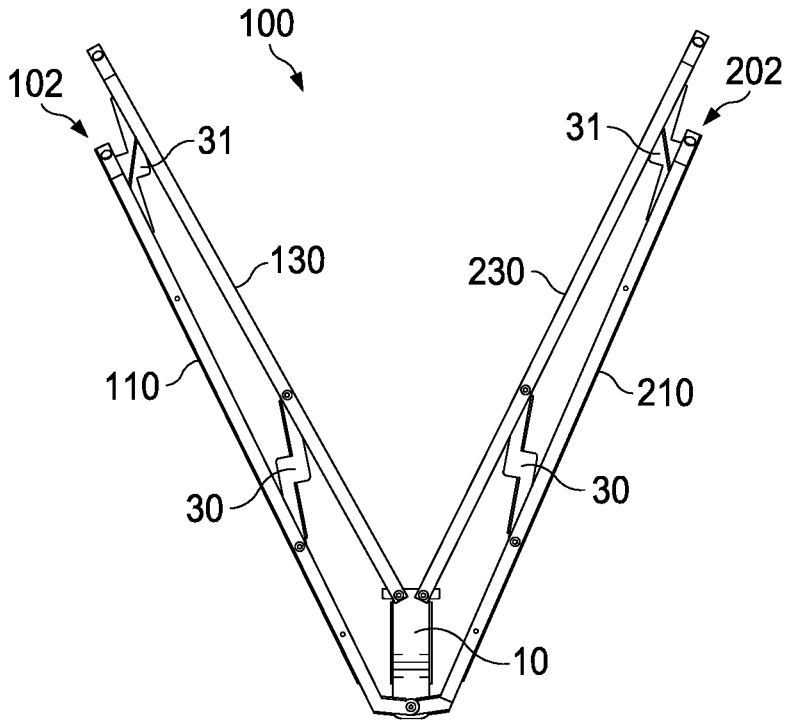
FIG. 2 is a side view of the example implementation of FIG. 1 shown in a partially open configuration.
Figure 3:
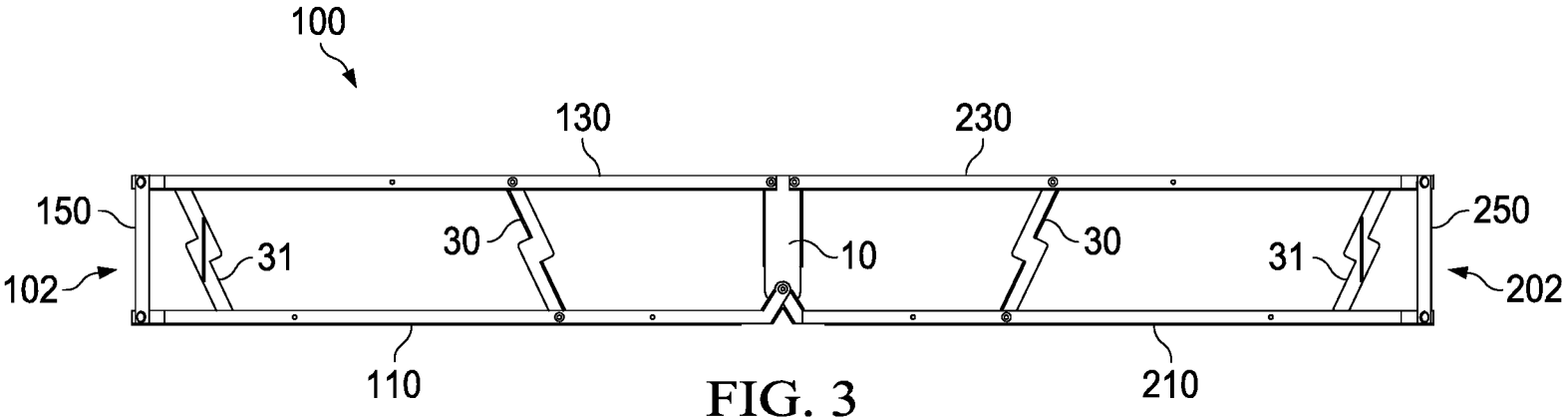
FIG. 3 is a side view of the example implementation of FIG. 1 shown in a completely open configuration.
Figure 4:
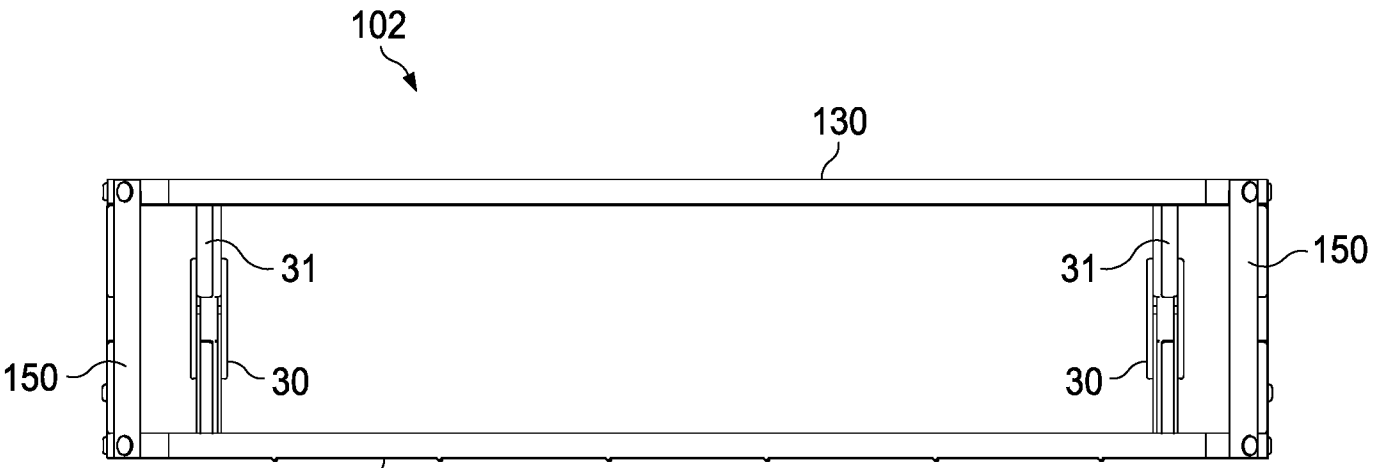
FIG. 4 is an end view of the example implementation of FIG. 1 shown in a completely open configuration.
Figure 5:
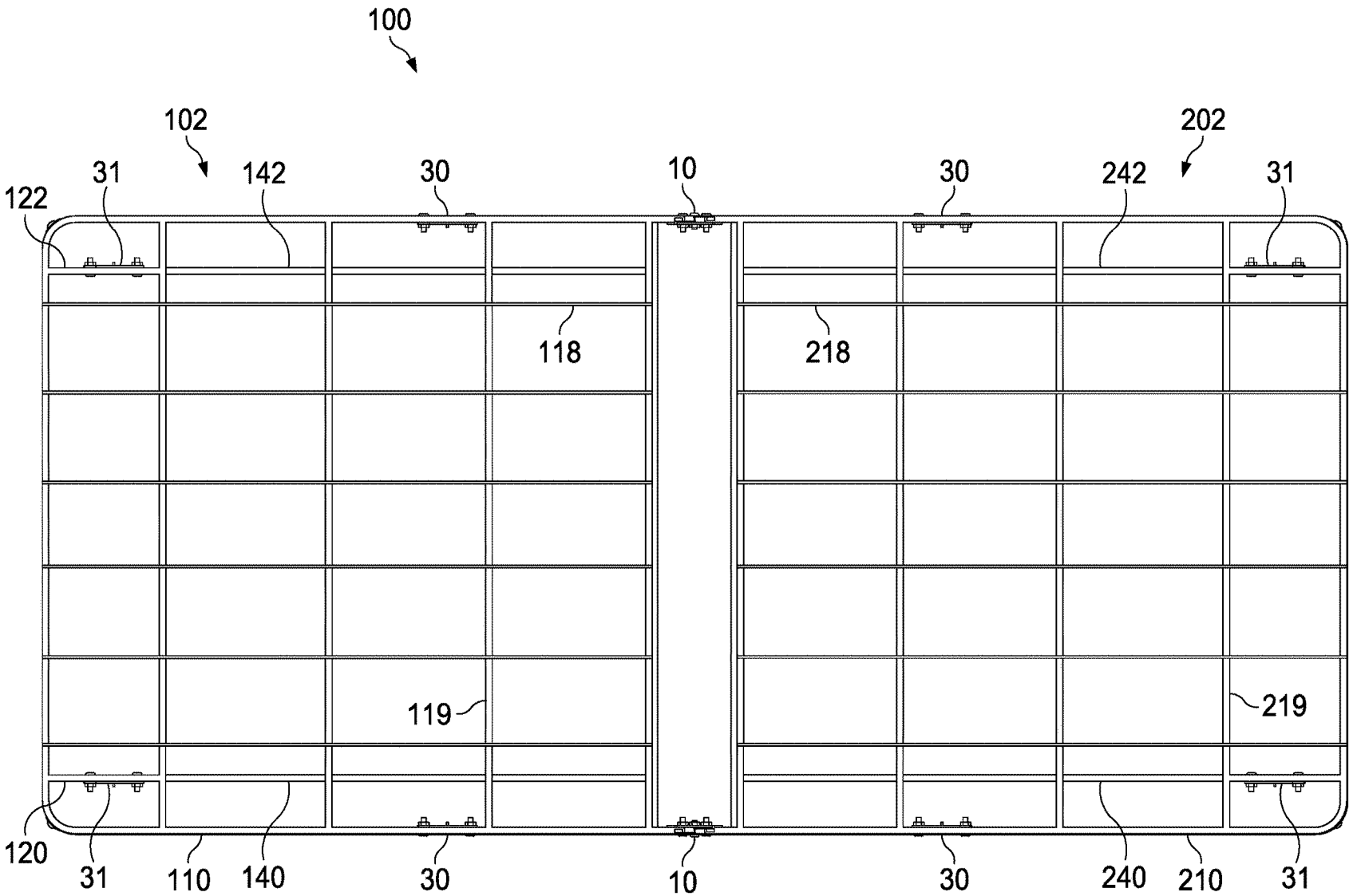
FIG. 5 is a top view of the example implementation of FIG. 1 shown in a completely open configuration.
Figure 6:
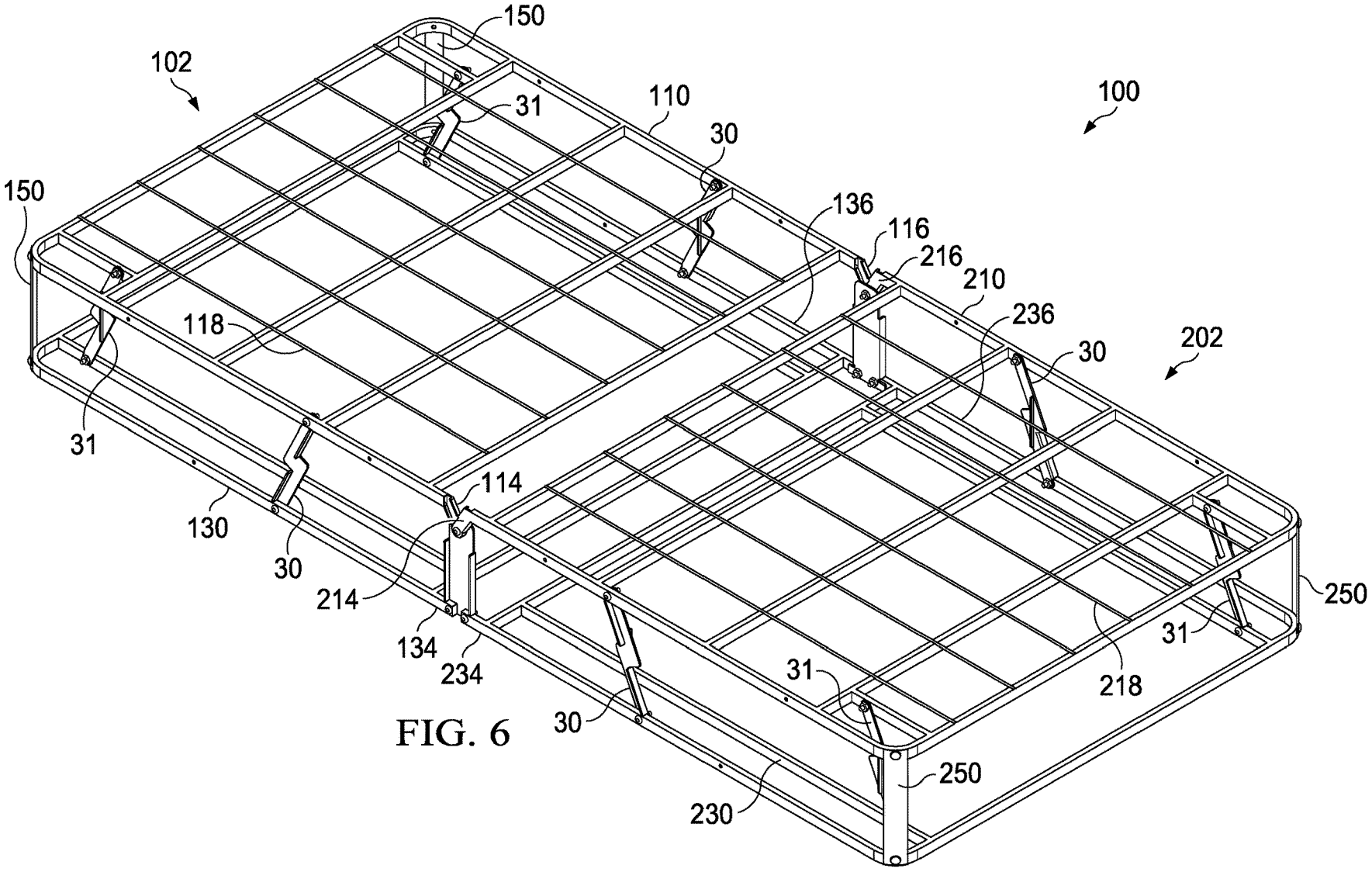
FIG. 6 is a bottom perspective view of the example implementation of FIG. 1 shown in a completely open configuration.
Figure 7B:
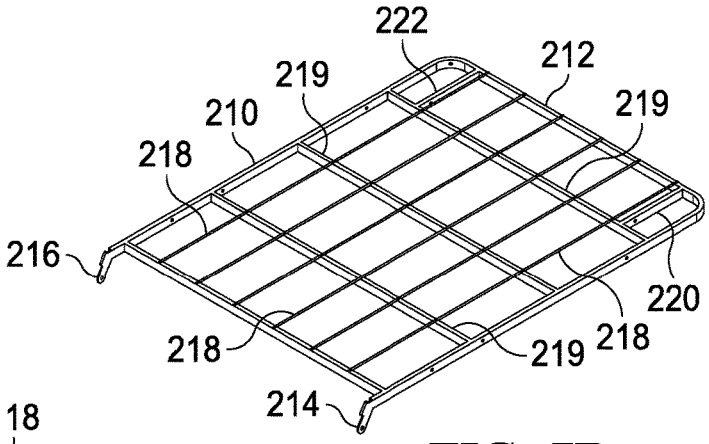
FIG. 7B is a perspective view of the second upper frame portion of the example implementation of FIG. 1.
Figure 7A:
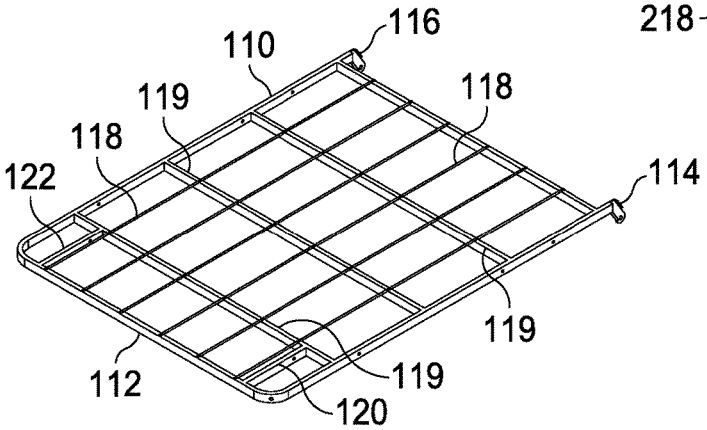
FIG. 7A is a perspective view of the first upper frame portion of the example implementation of FIG. 1.
Figure 8B:
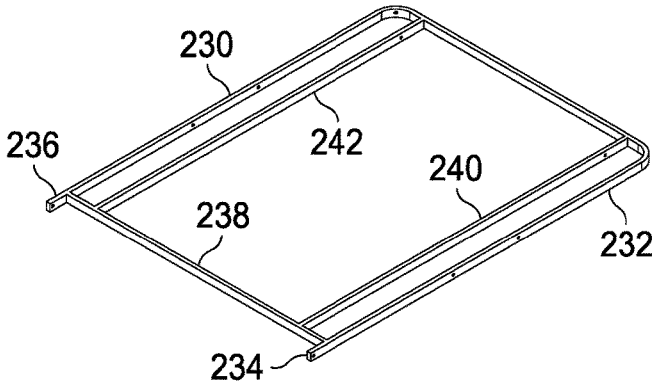
FIG. 8B is a perspective view of the second lower frame portion of the example implementation of FIG. 1.
Figure 8A:
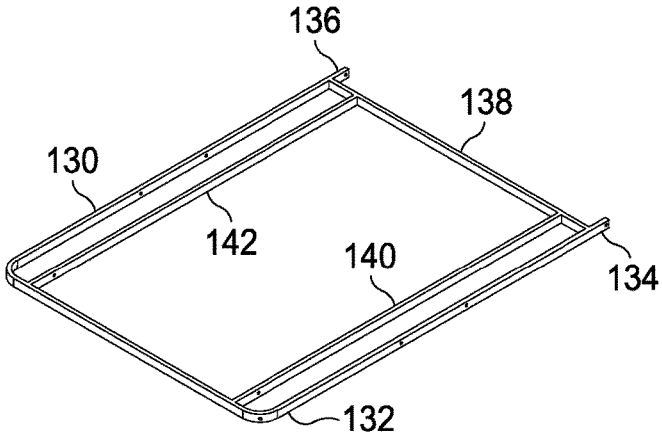
FIG. 8A is a perspective view of the first lower frame portion of the example implementation of FIG. 1.

FIG. 1 provides a side view of an example implementation of the disclosed folding box spring assembly shown in a completely closed configuration. FIG. 2 provides a side view of the example implementation of FIG. 1 shown in a partially open configuration. FIG. 3 provides a side view of the example implementation of FIG. 1 shown in a completely open configuration. FIG. 4 provides an end view of the example implementation of FIG. 1 shown in a completely open configuration. FIG. 5 provides a top view of the example implementation of FIG. 1 shown in a completely open configuration. FIG. 6 provides a bottom perspective view of the example implementation of FIG. 1 shown in a completely open configuration. FIG. 7A provides a perspective view of the first upper frame portion of the example implementation of FIG. 1. FIG. 7B provides a perspective view of the second upper frame portion of the example implementation of FIG. 1. FIG. 8A provides a perspective view of the first lower frame portion of the example implementation of FIG. 1. FIG. 8B provides a perspective view of the second lower frame portion of the example implementation of FIG. 1.

With reference to FIGS. 1-6, folding box spring assembly 100, which is also collapsible to a substantially flat configuration, includes first box spring subassembly 102 and second box spring subassembly 202. First box spring subassembly 102 includes first top frame portion 110 and first bottom frame portion 130. First top frame portion 110 includes outer frame 112, first angled bracket connector 114, second angled bracket connector 116, lengthwise crossbar supports 118, widthwise crossbar supports 119, first inner support 120, and second inner support 122. First bottom frame portion 130 includes outer frame 132, first angled bracket connector 134, second angled bracket connector 136, crossbar support 138, first inner support 140, and second inner support 142. Elastic or metal strap 150 or a similar item is used to connect first top frame portion 110 and first bottom frame portion 130 to one another for stabilizing first box spring subassembly 102 when folding box spring assembly 100 is fully opened. Second box spring subassembly 202 includes second top frame portion 210 and second bottom frame portion 230. Second top frame portion 210 includes outer frame 212, first angled bracket connector 214, second angled bracket connector 216, lengthwise crossbar supports 218, widthwise crossbar supports 219, first inner support 220, and second inner support 222. First bottom frame portion 230 includes outer frame 232, first angled bracket connector 234, second angled bracket connector 236, crossbar support 238, first inner support 240, and second inner support 242. Elastic or metal strap 250 or a similar item is used to connect second top frame portion 210 and second bottom frame portion 230 to one another for stabilizing second box spring subassembly 202 when folding box spring assembly 100 is fully opened.

Figure 9:
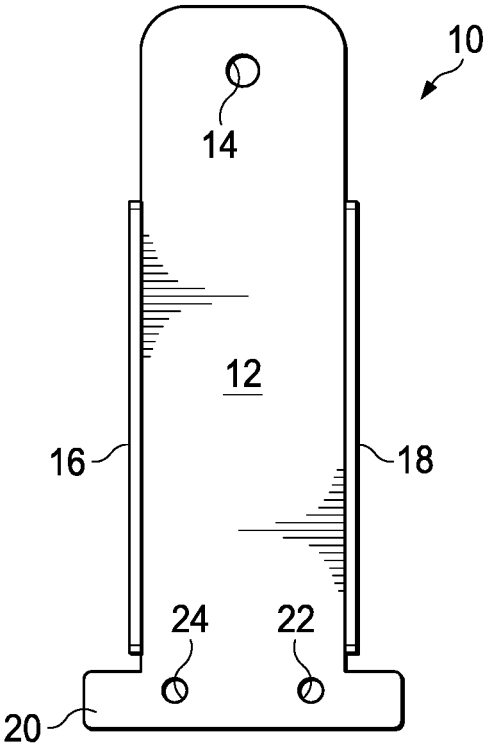
FIG. 9 is a top view of a T-bracket component of the disclosed folding box spring assembly.
Figure 10:
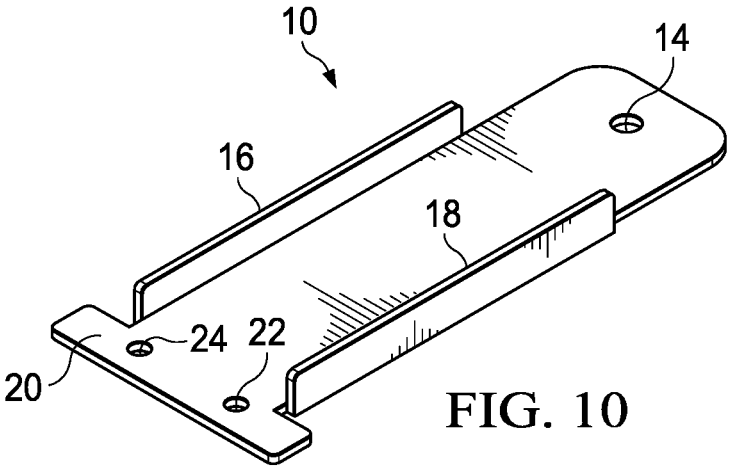
FIG. 10 is a top perspective view of the T-bracket component of the disclosed folding box spring assembly.
Figure 11:
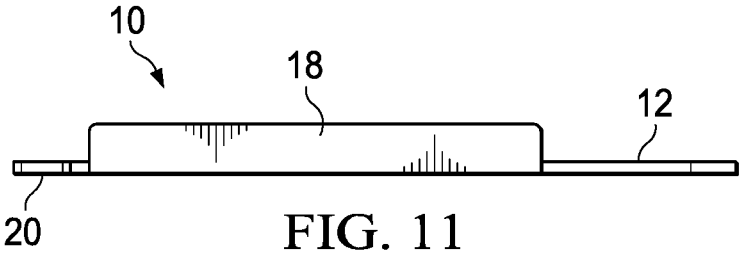
FIG. 11 is a side view of the T-bracket component of the disclosed folding box spring assembly.
Figure 12:
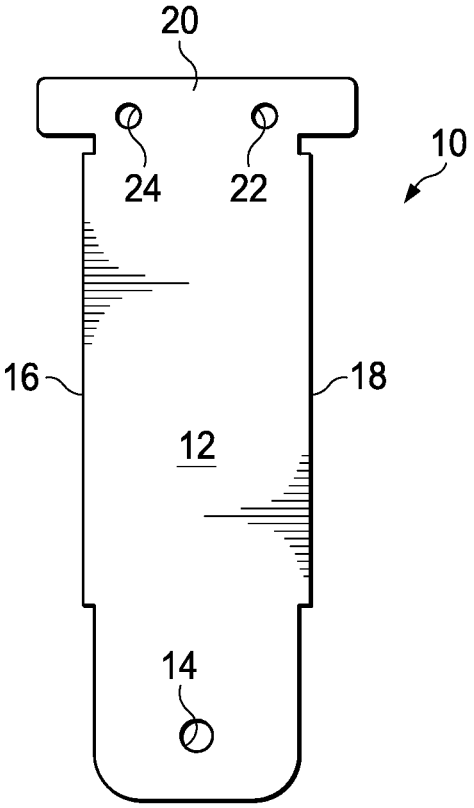
FIG. 12 is a bottom view of the T-bracket component of the disclosed folding box spring assembly.
Figure 13:
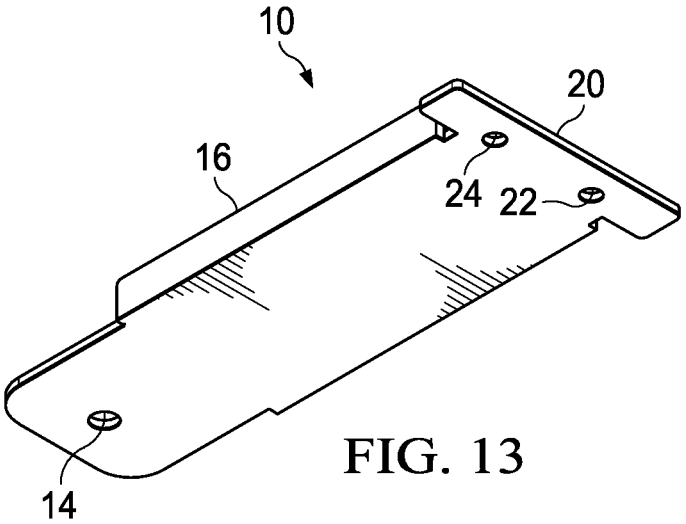
FIG. 13 is a bottom perspective view of the T-bracket component of the disclosed folding box spring assembly.
Figure 14:
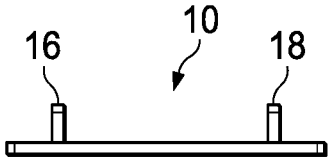
FIG. 14 is a front view of the T-bracket component of the disclosed folding box spring assembly.

FIG. 9 provides a top view of the T-bracket component of the disclosed folding box spring assembly. FIG. 10 provides a top perspective view of the T-bracket component of the disclosed folding box spring assembly. FIG. 11 provides a side view of the T-bracket component of the disclosed folding box spring assembly. FIG. 12 provides a bottom view of the T-bracket component of the disclosed folding box spring assembly. FIG. 13 provides a bottom perspective view of the T-bracket component of the disclosed folding box spring assembly. FIG. 14 provides a front view of the T-bracket component of the disclosed folding box spring assembly. The T-brackets are located along a middle latitude line of box spring assembly 100 where the assembly folds in half. There are three connection points on each T-bracket (two at the bottom and one at the top). Bottom frame portions 130 and 230 connect to the two connection points at the bottom of each T-bracket. Top frame portions 110 and 210 connect to a single connection point and overlap each other. This design enhances folding, thereby making the motion of folding smooth and uniform, and simplifies the manufacturing process. Also, by utilizing fewer moving parts, this configuration improves the overall quality and strength of box spring assembly 100.

With reference to FIGS. 9-14, each T-bracket 10 includes vertical portion 12, which includes first aperture 14, first vertical ridge 16, and second vertical ridge 18; and horizontal portion 20, which includes second aperture 22, and third aperture 24. Each of the disclosed apertures is adapted to receive a bolt or pin 26 for attaching the T-bracket to the upper and lower frame portions of folding box spring assembly 100. Each of the disclosed ridges operates to stabilize box spring assembly 100 when it is in the closed position.

Figure 15:
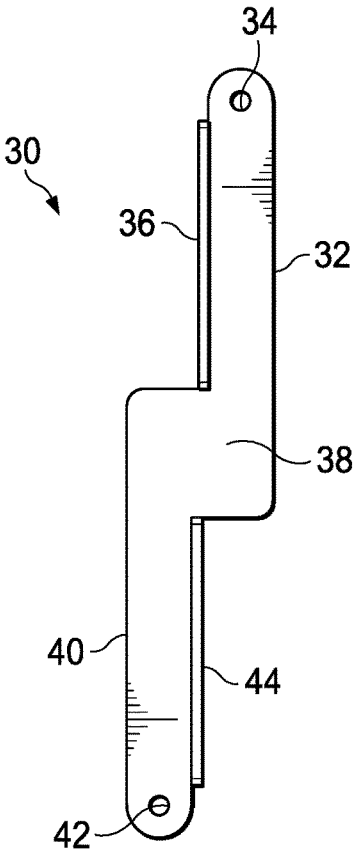
FIG. 15 is a top view of a Z-link component of the disclosed folding box spring assembly.
Figure 16:
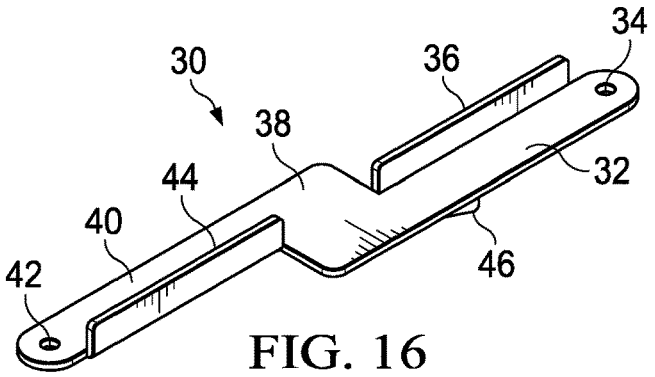
FIG. 16 is a top perspective view of the Z-link component of the disclosed folding box spring assembly.
Figure 17:
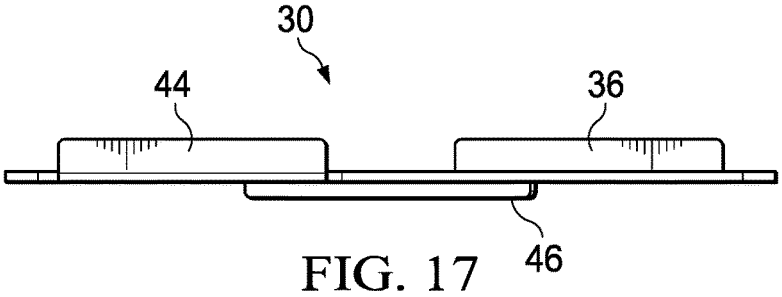
FIG. 17 is a side view of the Z-link component of the disclosed folding box spring assembly.
Figure 18:
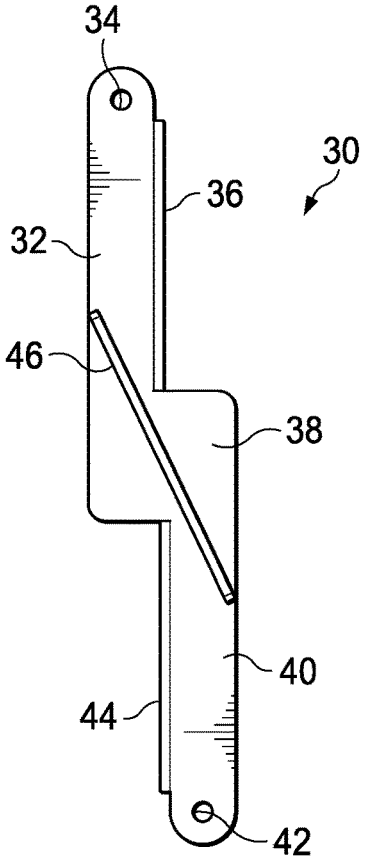
FIG. 18 is a bottom view of the Z-link component of the disclosed folding box spring assembly.
Figure 19:
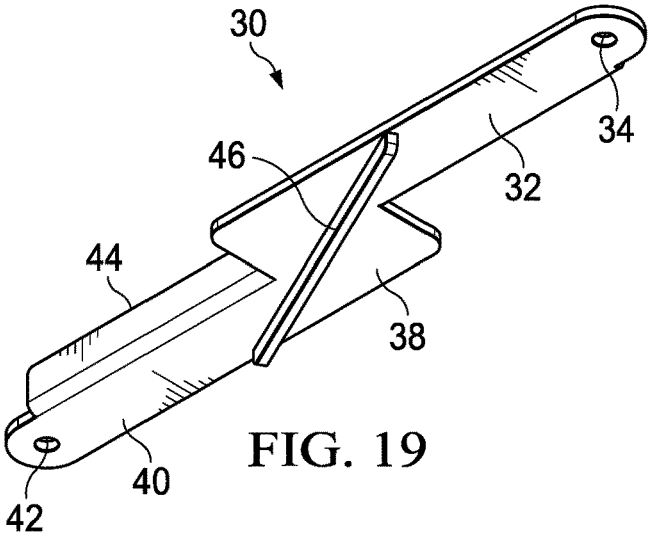
FIG. 19 is a bottom perspective view of the Z-link component of the disclosed folding box spring assembly.
Figure 20:
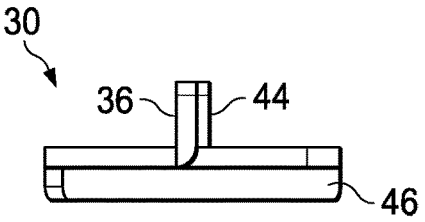
FIG. 20 is a front view of the Z-link component of the disclosed folding box spring assembly.

FIG. 15 provides a top view of the Z-link component of the disclosed folding box spring assembly. FIG. 16 provides a top perspective view of the Z-link component of the disclosed folding box spring assembly. FIG. 17 provides a side view of the Z-link component of the disclosed folding box spring assembly. FIG. 18 provides a bottom view of the Z-link component of the disclosed folding box spring assembly. FIG. 19 provides a bottom perspective view of the Z-link component of the disclosed folding box spring assembly. FIG. 20 provides a front view of the Z-link component of the disclosed folding box spring assembly. Each Z-link attaches top frame portions 110 and 210 to bottom frame portions 130 and 230, thereby allowing the frame portions to expand or collapse as box spring assembly 100 is folded. When box spring assembly 100 is unfolded, the Z-links push the top and bottom frame portions away from each other, and when the box spring is fully unfolded and laid flat, the Z-links lock in place when weight is applied to the top of box spring assembly 100, thereby creating a secure foundation for a mattress and eliminating any shifting between the top and bottom frame portions.

With reference to FIGS. 15-20, each Z-link 30 and 31 includes first vertical portion 32, which includes first aperture 34 and first vertical ridge 36; horizontal portion 38; second vertical portion 40, which includes second aperture 42 and second vertical ridge 44. Diagonal ridge 46 is positioned on the side of Z-link 30 opposite vertical ridges 36 and 44. Each of the disclosed apertures is adapted to receive a bolt or pin 48 for attaching the Z-link to the upper and lower frame portions of folding box spring assembly 100. Each of the disclosed ridges operates to stabilize box spring assembly 100 when it is in the closed position.

As best shown in FIGS. 1-3, an example implementation of folding box spring assembly 100 includes first box spring subassembly 102 and second box spring subassembly 202 connected to one another in a hinged, collapsible manner using two T-brackets 10, four Z-links 30, and four Z-links 31, which allow the two subassemblies to simultaneously collapse and fold together at three axes as shown in FIGS. 1-2. T-brackets 10 are located midway between first box spring subassembly 102 and second box spring subassembly 202. First bracket connector 114 and second bracket connector 214 are connected to a first T-bracket 10 at first aperture 14 using a bolt or pin 26. Second bracket connector 116 and second bracket connector 216 are connected to a second T-bracket 10 at first aperture 14 using a pin 26. First bracket connector 134 is connected to the first T-bracket 10 at second aperture 22 using a pin 26 and first bracket connector 234 is connected to the first T-bracket 10 at third aperture 24 using a pin 26. Second bracket connector 136 is connected to the second T-bracket 10 at third aperture 24 and second bracket connector 236 is connected to the second T-bracket 10 at second aperture 22 using a pin 26.

As best shown in FIGS. 1-3, four Z-links 30, and four Z-links 31, are used to flexibly connect first and second top frame portions 110 and 210 to first and second bottom frame portions 130 and 230 respectively using pins 48. Each of the Z-links acts to expand or collapse the various frame portions relative to one another as folding box spring assembly 100 is being either opened or closed. In the implementations shown in the drawings, inner Z-links 30 are mounted with diagonal ridge 46 facing inward, while outer or end Z-links 31 are mounted with diagonal ridge 46 facing outward.

Figure 21:
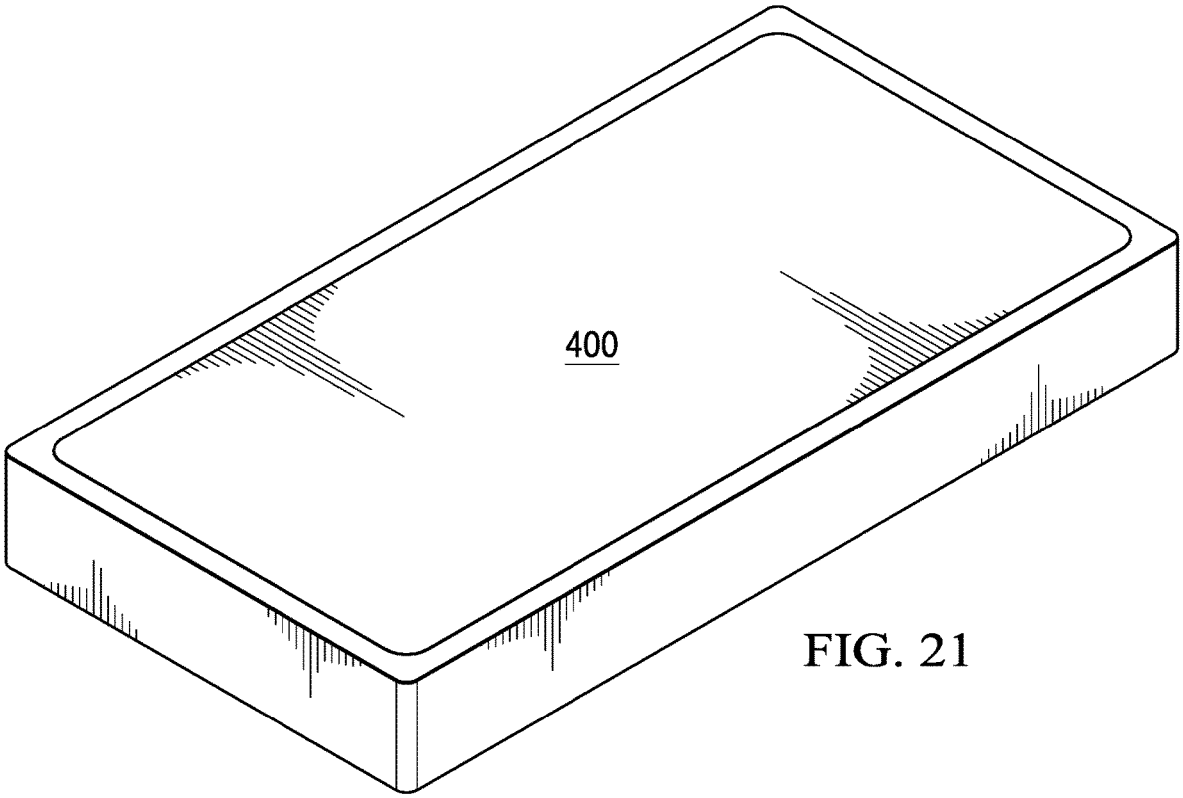
FIG. 21 is a top perspective view of the cover component of the disclosed folding box spring assembly.
Figure 22:
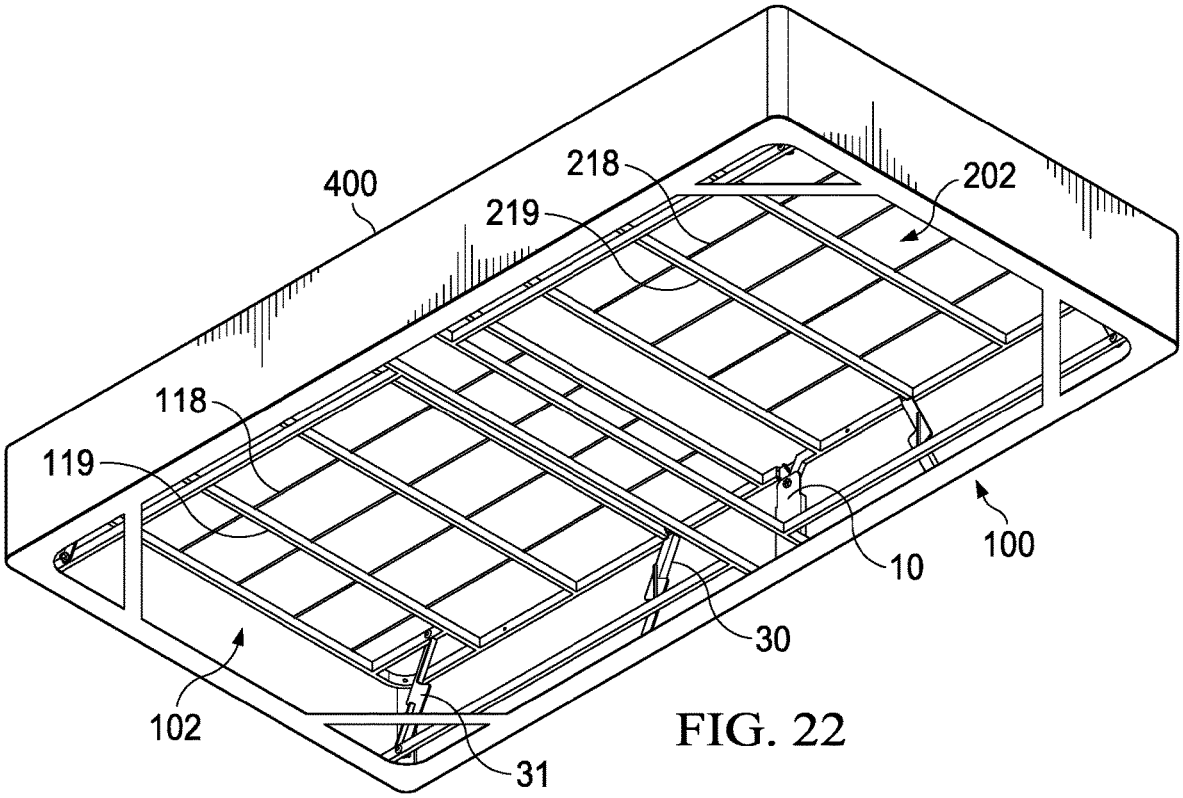
FIG. 22 is a bottom perspective view of the cover component of FIG. 21 installed on the folding box spring assembly.
Figure 23:
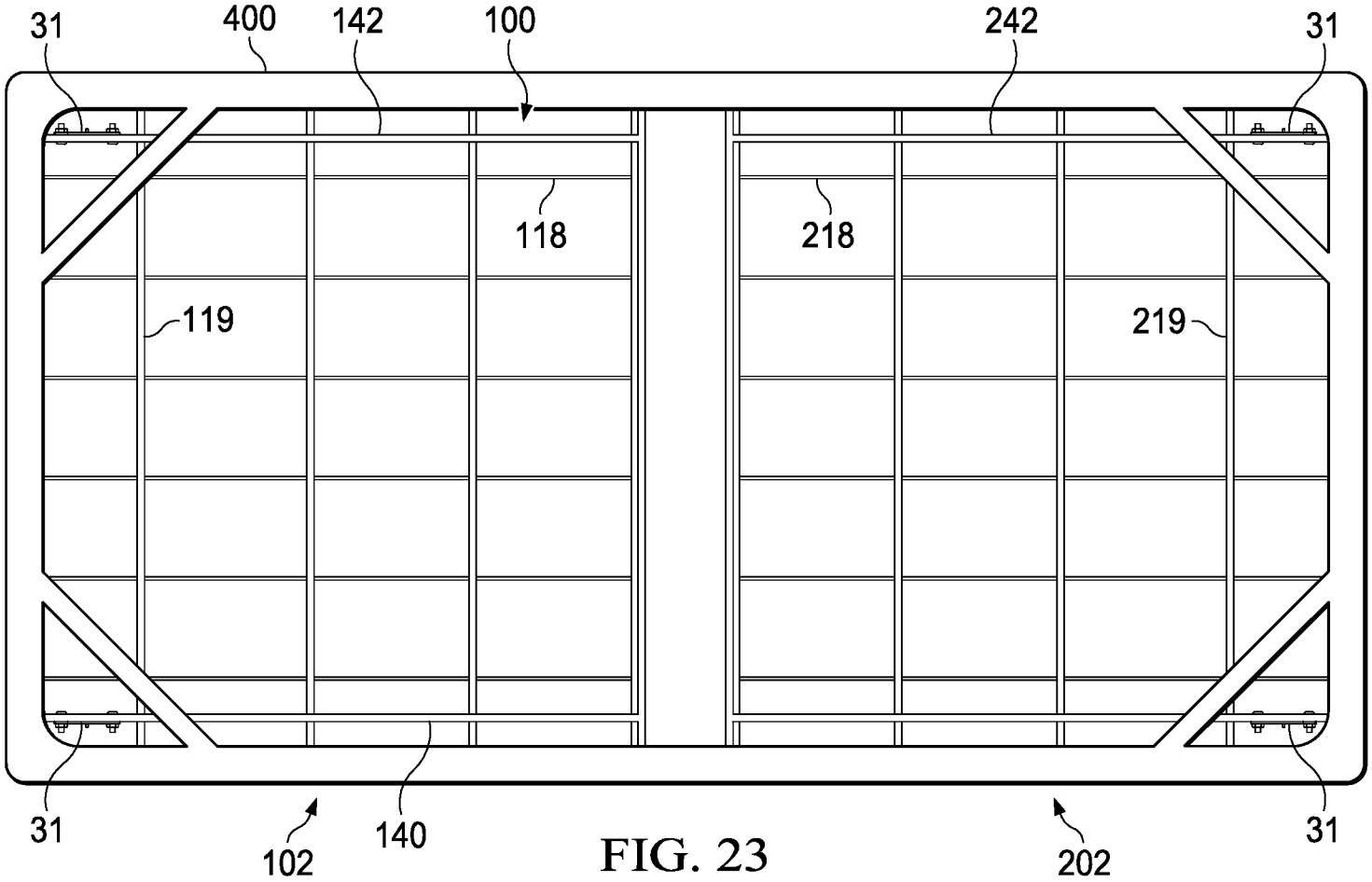
FIG. 23 is a bottom view of the cover component of FIG. 21 installed on the folding box spring assembly.

FIG. 21 provides a top perspective view of the cover component of the disclosed folding box spring assembly. FIG. 22 provides a bottom perspective view of cover 400 installed on folding box spring assembly 100. FIG. 23 provides a bottom view of cover 400 installed on the folding box spring assembly. Cover 400 encloses the upper portion of folding box spring assembly 100, thereby increasing the aesthetic quality of folding box spring assembly 100 and providing protection both to the user and the components of folding box spring assembly 100. Cover 400 is a fitted cloth cover having elastic bands that span diagonally across all four corners and may include fluid-resistant and fire-resistant materials. The sidewalls of cover 400 may be 300 gsm fabric having an unwoven cloth layer on the top flat surface.

In one example implementation, when the product is unfolded it is nine inches tall and is suitable for supporting a mattress. Twin and Twin XL sizes include a single piece or assembly that does not use additional attachment hardware. Full, Queen, King, and Cal King sizes utilize a two-piece or two-assembly design, wherein two pieces or two assemblies are connected to one another using additional hardware to create a larger assembly. The hardware may include four bolts, four spacers, and four nuts mounted on the top frame portions (see FIG. 24), and two bolts, two spacers, and two nuts mounted on the bottom frame portion (see FIG. 24). The bolts and nuts may be steel and the spacer may be plastic.

Figure 24:
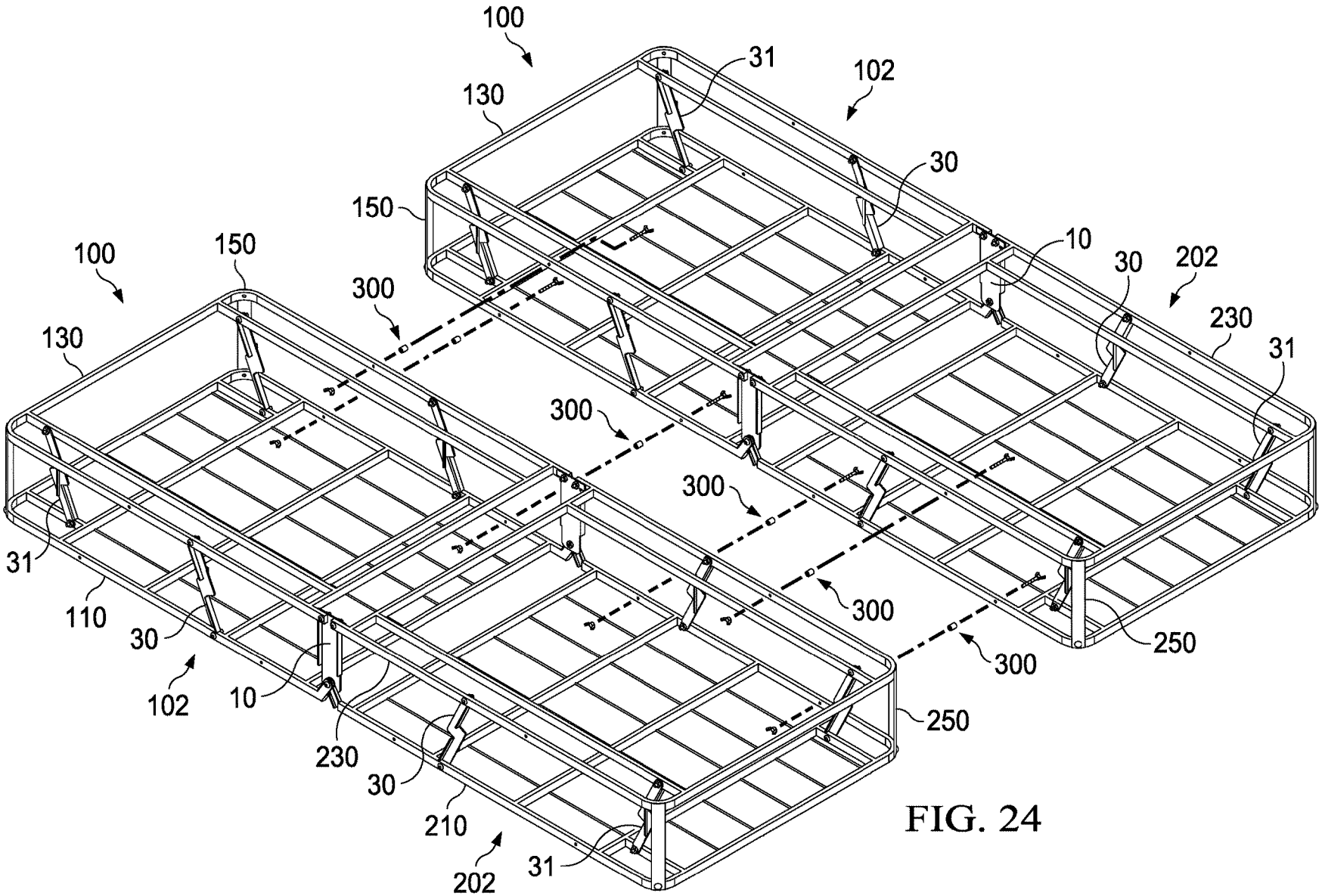
FIG. 24 is a perspective view of an example implementation of a double folding box spring assembly, wherein two individual folding box spring assemblies are joinable to one another using a plurality of connector bolts.
Figure 25:
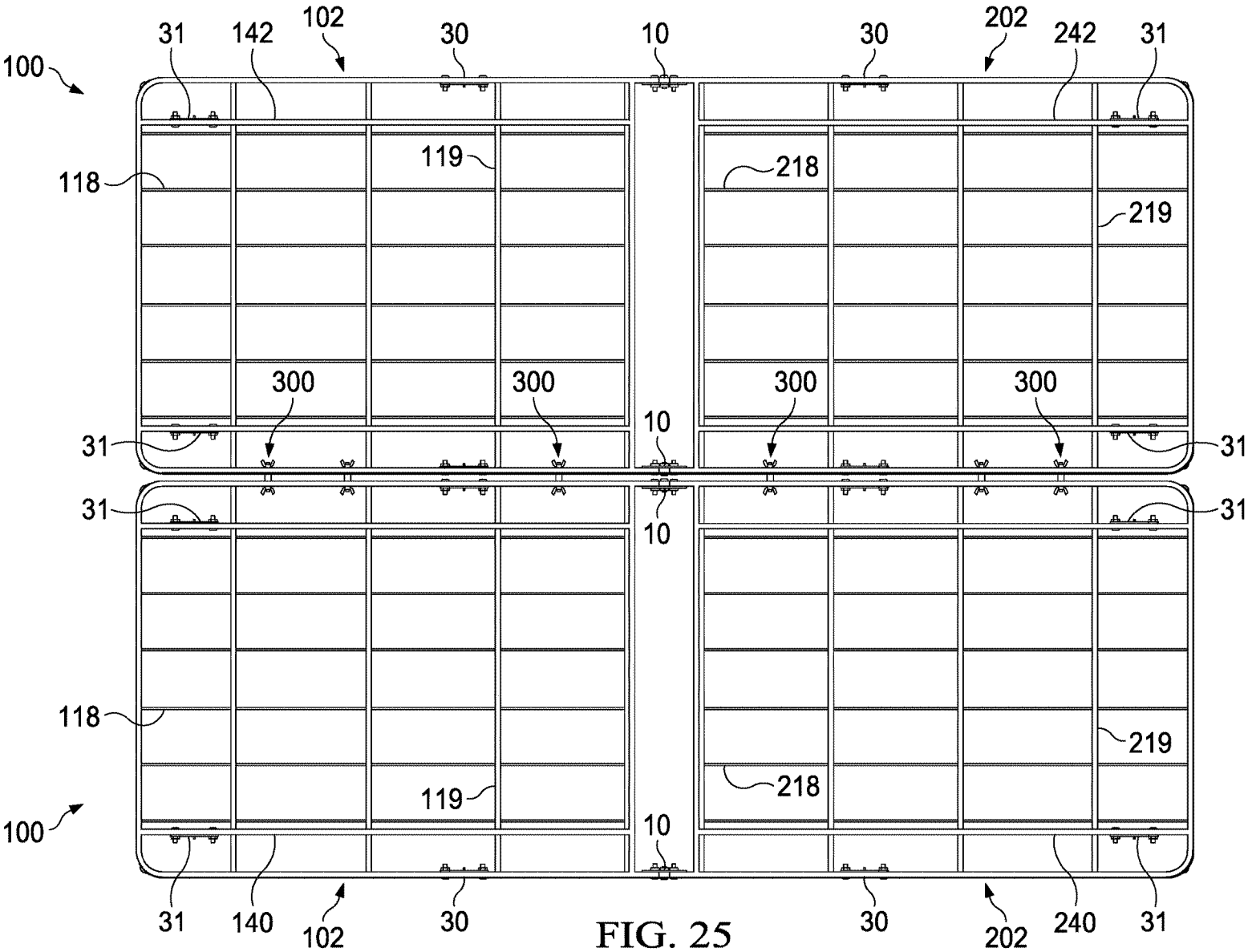
FIG. 25 is a bottom view of an example implementation of a double folding box spring assembly, wherein two individual box spring assemblies are joined together along the length thereof using a plurality of connector bolts.

FIG. 24 provides a perspective view of an example implementation of a double folding box spring assembly for use with larger mattress sizes, wherein two individual folding box spring assemblies 100 are joined to one another. FIG. 25 provides a bottom view of an example implementation of a double folding box spring assembly, wherein two individual box spring assemblies 100 are joined together along the length thereof using a plurality of connector bolt assemblies 300. Each connector bolt assembly 300 may include threaded bolts, spacers, and wing nuts. Other configurations and components are possible for connecting the two folding box spring assemblies 100.

Figure 26:
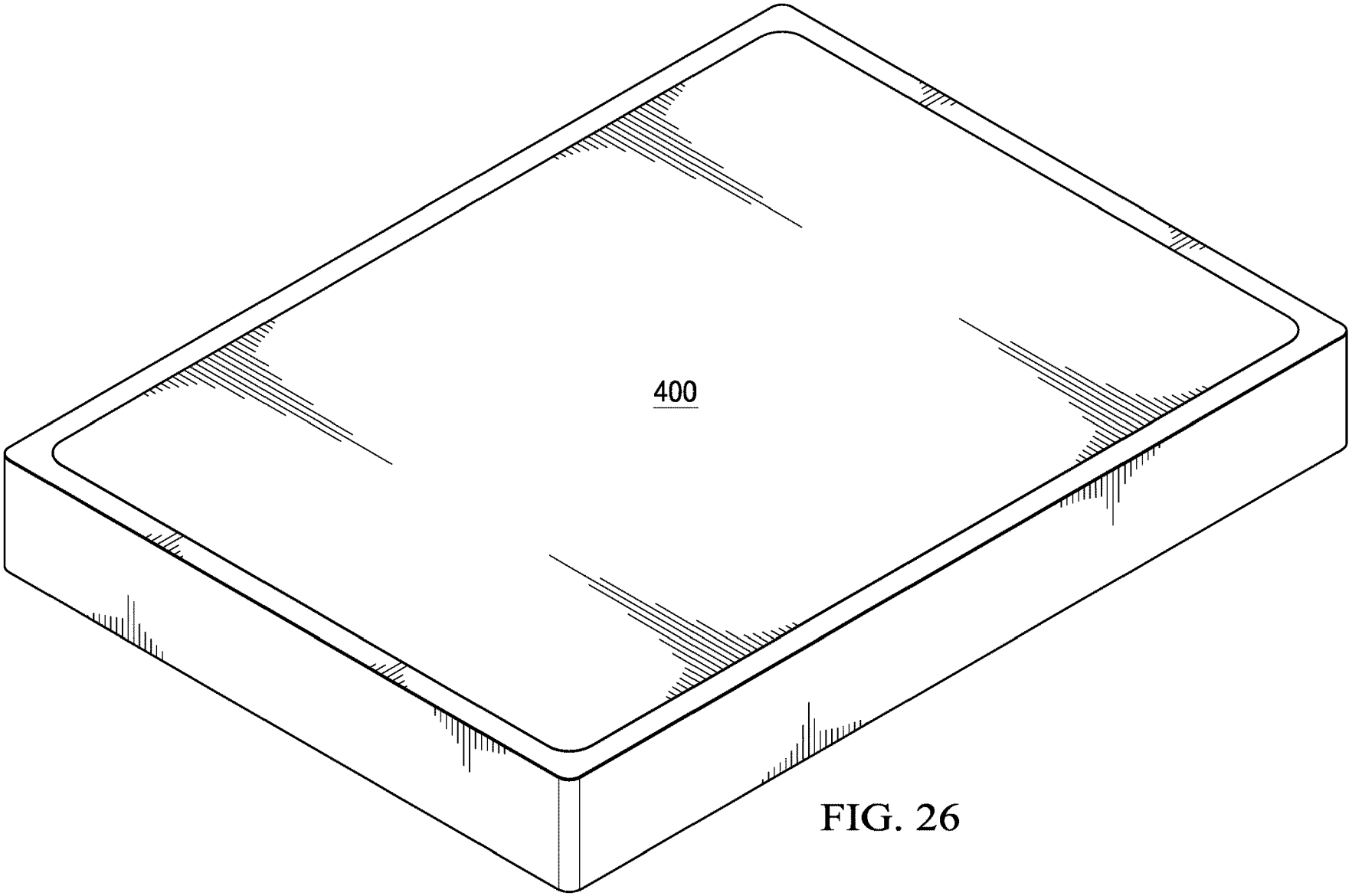
FIG. 26 is a bottom perspective view of the cover component of the disclosed double folding box spring assembly.
Figure 27:
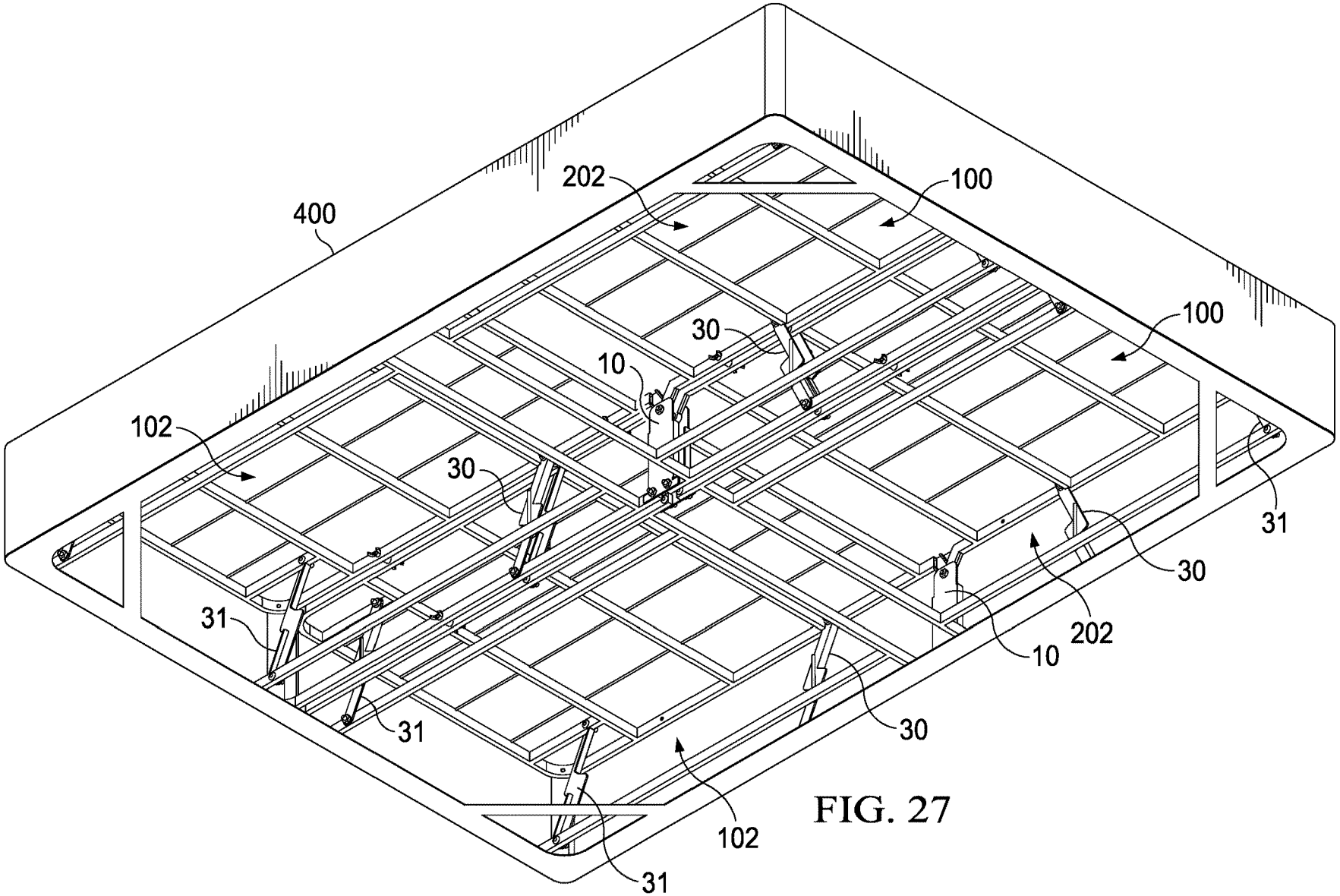
FIG. 27 is a bottom perspective view of the cover component of FIG. 26 installed on the double folding box spring assembly.
Figure 28:
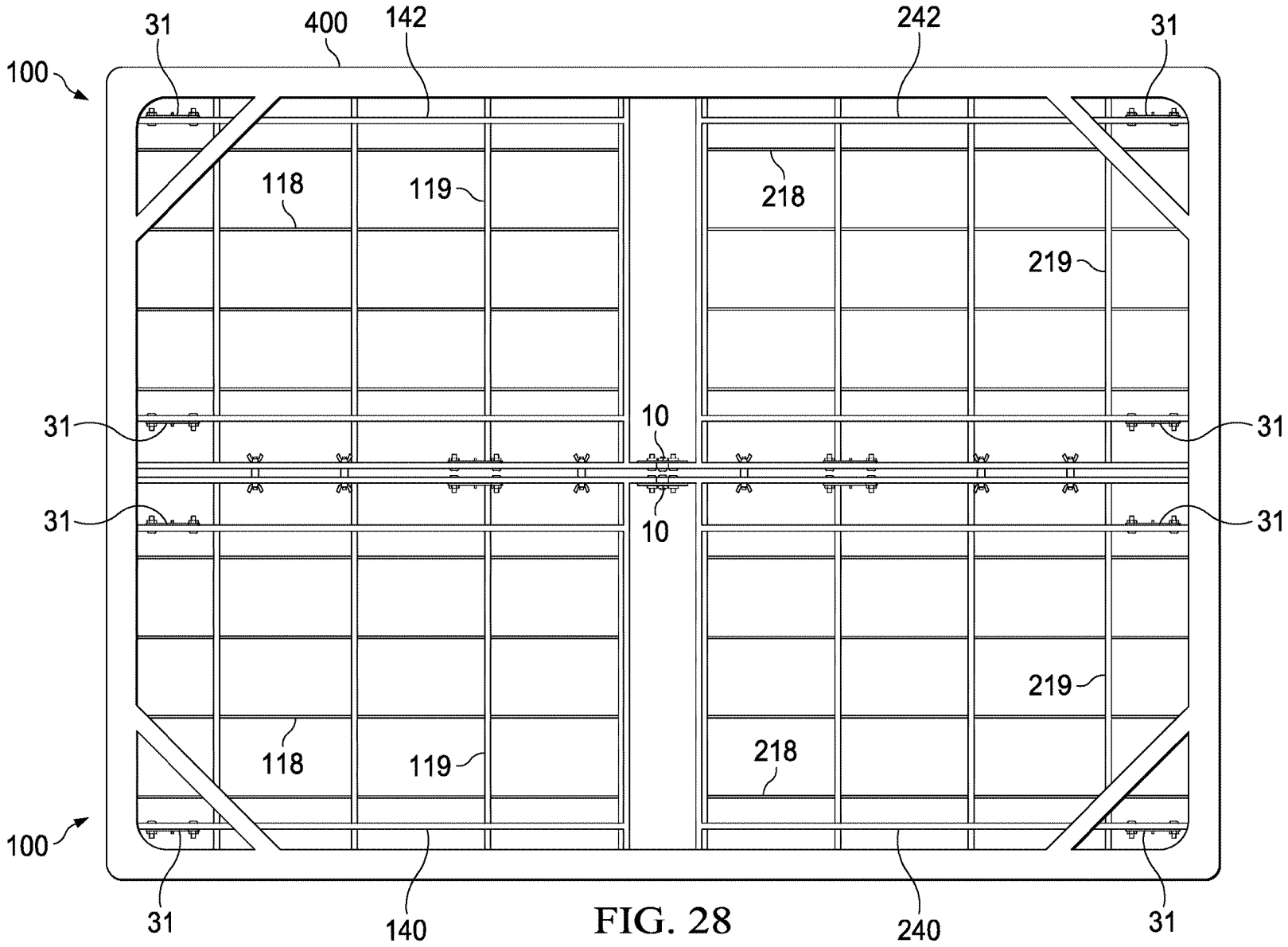
FIG. 28 is a bottom view of the cover component of FIG. 26 installed on the double folding box spring assembly.

FIG. 26 provides a bottom perspective view of the cover component of the disclosed double folding box spring assembly. FIG. 27 provides a bottom perspective view of cover 400 installed on the double folding box spring assembly. FIG. 28 provides a bottom view of cover 400 installed on the double folding box spring assembly. Cover 400 encloses the upper portion of both folding box spring assemblies 100, thereby increasing the aesthetic quality of the joined folding box spring assemblies 100 and providing protection both to the user and the components of the joined folding box spring assemblies 100. Double cover 400 may include fluid-resistant and fire-resistant materials.

All literature and similar material cited in this application, including, but not limited to, patents, patent applications, articles, books, treatises, and web pages, regardless of the format of such literature and similar materials, are expressly incorporated by reference in their entirety. Should one or more of the incorporated references and similar materials differs from or contradicts this application, including but not limited to defined terms, term usage, described techniques, or the like, this application controls.

As previously stated and as used herein, the singular forms "a," "an," and "the," refer to both the singular as well as plural, unless the context clearly indicates otherwise. The term "comprising" as used herein is synonymous with "including," "containing," or "characterized by," and is inclusive or open-ended and does not exclude additional, unrecited elements or method steps. Although many methods and materials similar or equivalent to those described herein can be used, particular suitable methods and materials are described herein. Unless context indicates otherwise, the recitations of numerical ranges by endpoints include all numbers subsumed within that range. Furthermore, references to "one implementation" are not intended to be interpreted as excluding the existence of additional implementations that also incorporate the recited features. Moreover, unless explicitly stated to the contrary, implementations "comprising" or "having" an element or a plurality of elements having a particular property may include additional elements whether or not they have that property.

The terms "substantially" and "about" used throughout this specification are used to describe and account for small fluctuations, such as due to variations in processing. For example, these terms can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%, and/or 0%.

Underlined and/or italicized headings and subheadings are used for convenience only, do not limit the disclosed subject matter, and are not referred to in connection with the interpretation of the description of the disclosed subject matter. All structural and functional equivalents to the elements of the various implementations described throughout this disclosure that are known or later come to be known to those of ordinary skill in the art are expressly incorporated herein by reference and intended to be encompassed by the disclosed subject matter. Moreover, nothing disclosed herein is intended to be dedicated to the public regardless of whether such disclosure is explicitly recited in the above description.

There may be many alternate ways to implement the disclosed inventive subject matter. Various functions and elements described herein may be partitioned differently from those shown without departing from the scope of the disclosed inventive subject matter. Generic principles defined herein may be applied to other implementations. Different numbers of a given module or unit may be employed, a different type or types of a given module or unit may be employed, a given module or unit may be added, or a given module or unit may be omitted.

It should be appreciated that all combinations of the foregoing concepts and additional concepts discussed in greater detail herein (provided such concepts are not mutually inconsistent) are contemplated as being part of the disclosed inventive subject matter. In particular, all combinations of claimed subject matter appearing at the end of this disclosure are contemplated as being part of the inventive subject matter disclosed herein. While the disclosed inventive subject matter has been illustrated by the description of example implementations, and while the example implementations have been described in certain detail, there is no intention to restrict or in any way limit the scope of the appended claims to such detail. Additional advantages and modifications will readily appear to those skilled in the art. Therefore, the disclosed inventive subject matter in its broader aspects is not limited to any of the specific details, representative devices and methods, and/or illustrative examples shown and described. Accordingly, departures may be made from such details without departing from the spirit or scope of the general inventive concept.

What is claimed:

1. A collapsible folding box spring assembly, comprising:

(a) a first box spring subassembly, wherein the first box spring subassembly includes a top frame portion and a bottom frame portion, wherein the top frame portion includes a first angled bracket connector and a second angled bracket connector located opposite the first angled bracket connector, and wherein the bottom frame portion includes a first bracket connector and a second bracket connector located opposite the first bracket connector;

(b) a second box spring subassembly, wherein the second box spring subassembly includes a top frame portion and a bottom frame portion, wherein the top frame portion includes a first angled bracket connector and a second angled bracket connector located opposite the first angled bracket connector, and wherein the bottom frame portion includes a first bracket connector and a second bracket connector located opposite the first bracket connector;

(c) first and second single-piece T-brackets positioned opposite one another between the first and second box spring subassemblies, (i) wherein each single piece T-bracket includes a vertical portion having a first aperture therein and a horizontal portion having a second aperture therein and a third aperture therein, (ii) wherein the first angled bracket connector on the top portion of the first box spring subassembly and the first angled bracket connector on the top portion of the second box spring subassembly overlap one another and are both hingeably connected to the first aperture of the first single-piece T-bracket, wherein the second angled bracket connector on the top portion of the first box spring subassembly and the second angled bracket connector on the top portion of the second box spring subassembly overlap one another and are both hingeably connected to the first aperture of the second single-piece T-bracket, and wherein the opposing first apertures of the single-piece T-brackets form a first axis, (iii) wherein the first bracket connector on the bottom portion of the first box spring subassembly is hingeably connected to the second aperture of the first single-piece T-bracket, and wherein the second bracket connector on the bottom portion of the first box spring subassembly is hingeably connected to the second aperture of the second single-piece T-bracket, and wherein the opposing second apertures of the single-piece T-brackets form a second axis, (iv) wherein the first bracket connector on the bottom portion of the second box spring subassembly is hingeably connected to the third aperture of the first single-piece T-bracket, and wherein the second bracket connector on the bottom portion of the second box spring subassembly is hingeably connected to the third aperture of the second single-piece T-bracket, and wherein the opposing third apertures of the single-piece T-brackets form a third axis, (d) a plurality of rotating Z-links located between the top and bottom frame portions of the first and second box spring subassemblies, (i) wherein each Z-link expands the top frame portions away from bottom frame portions of the first and second box spring subassemblies when in an open configuration, (ii) wherein each Z-link collapses the top frame portions toward the bottom frame portions of the first and second box spring subassemblies when in a closed configuration, and (iii) wherein each Z-link includes ridges formed thereon for engaging both top and both bottom frame portions.

2. The collapsible folding box spring assembly of claim 1, further comprising a plurality of stabilizing straps extending between the top and bottom frame portions of the first and second box spring subassemblies.

3. The collapsible folding box spring assembly of claim 1, further comprising a cover adapted to be placed over the top of the folding box spring assembly.

4. The collapsible folding box spring assembly of claim 3, wherein the cover includes four corners and wherein an elastic band is positioned diagonally in each corner for securing the cover to the box spring subassemblies.

5. The collapsible folding box spring assembly of claim 1, further comprising a plurality of connecting bolts for connecting the folding box spring assembly to a second folding box spring assembly.

6. The collapsible folding box spring assembly of claim 1, wherein each top frame portion further includes lengthwise and widthwise crossbar supports located between an outer frame.

7. The collapsible folding box spring assembly of claim 1, wherein each bottom frame portion further includes lengthwise and widthwise crossbar supports located between an outer frame.

8. The collapsible folding box spring assembly of claim 1, wherein each T-bracket further includes ridges formed thereon for engaging both top and both bottom frame portions.

9. A collapsible folding box spring assembly, comprising:

(a) a first box spring subassembly, wherein the first box spring subassembly includes a top frame portion and a bottom frame portion, wherein the top frame portion includes a first angled bracket connector and a second angled bracket connector located opposite the first angled bracket connector, and wherein the bottom frame portion includes a first bracket connector and a second bracket connector located opposite the first bracket connector;

(b) a second box spring subassembly, wherein the second box spring subassembly includes a top frame portion and a bottom frame portion, wherein the top frame portion includes a first angled bracket connector and a second angled bracket connector located opposite the first angled bracket connector, and wherein the bottom frame portion includes a first bracket connector and a second bracket connector located opposite the first bracket connector;

(c) first and second single-piece T-brackets positioned opposite one another between the first and second box spring subassemblies, (i) wherein each single piece T-bracket includes a vertical portion having a first aperture therein and a horizontal portion having a second aperture therein and a third aperture therein, (ii) wherein the first angled bracket connector on the top portion of the first box spring subassembly and the first angled bracket connector on the top portion of the second box spring subassembly overlap one another and are both hingeably connected to the first aperture of the first single-piece T-bracket, wherein the second angled bracket connector on the top portion of the first box spring subassembly and the second angled bracket connector on the top portion of the second box spring subassembly overlap one another and are both hingeably connected to the first aperture of the second single-piece T-bracket, and wherein the opposing first apertures of the single-piece T-brackets form a first axis, (iii) wherein the first bracket connector on the bottom portion of the first box spring subassembly is hingeably connected to the second aperture of the first single-piece T-bracket, and wherein the second bracket connector on the bottom portion of the first box spring subassembly is hingeably connected to the second aperture of the second single-piece T-bracket, and wherein the opposing second apertures of the single-piece T-brackets form a second axis, (iv) wherein the first bracket connector on the bottom portion of the second box spring subassembly is hingeably connected to the third aperture of the first single-piece T-bracket, and wherein the second bracket connector on the bottom portion of the second box spring subassembly is hingeably connected to the third aperture of the second single-piece T-bracket, and wherein the opposing third apertures of the single-piece T-brackets form a third axis, (v) wherein the top frame portions collapse toward the second and third axes of the single-piece T-brackets, and (vi) wherein the top frame portions expand toward the first axis of the single-piece T-brackets; and (d) a plurality of rotating Z-links located between the top and bottom frame portions of the first and second box spring subassemblies, (i) wherein each Z-link expands the top frame portions away from bottom frame portions of the first and second box spring subassemblies when in an open configuration, (ii) wherein each Z-link collapses the top frame portions toward the bottom frame portions of the first and second box spring subassemblies when in a closed configuration, and (iii) wherein each Z-link includes ridges formed thereon for engaging both top and both bottom frame portions.

10. The collapsible folding box spring assembly of claim 9, wherein the cover includes four corners and wherein an elastic band is positioned diagonally in each corner for securing the cover to the box spring subassemblies.

11. The collapsible folding box spring assembly of claim 9, further comprising a plurality of connecting bolts for connecting the folding box spring assembly to a second folding box spring assembly.

12. The collapsible folding box spring assembly of claim 9, wherein each top frame portion further includes lengthwise and widthwise crossbar supports located between an outer frame.

13. The collapsible folding box spring assembly of claim 9, wherein each bottom frame portion further includes lengthwise and widthwise crossbar supports located between an outer frame.

14. The collapsible folding box spring assembly of claim 9, wherein each T-bracket further includes ridges formed thereon for engaging both top and both bottom frame portions.

* * * * *